US008849165B2

(12) United States Patent
Tamarez Gomez et al.

(10) Patent No.: US 8,849,165 B2
(45) Date of Patent: Sep. 30, 2014

(54) WIRE-WRAPPED GROOVED ROLLERS FOR CLEANING ACTION USING BRUSH-LIKE SYSTEM

(75) Inventors: Frank B. Tamarez Gomez, Rochester, NY (US); Timothy P. Foley, Marion, NY (US); Douglas A. Gutberlet, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 90 days.

(21) Appl. No.: 13/473,966

(22) Filed: May 17, 2012

(65) Prior Publication Data

US 2013/0308987 A1 Nov. 21, 2013

(51) Int. Cl.
*G03G 15/08* (2006.01)

(52) U.S. Cl.
CPC .... *G03G 15/0803* (2013.01); *G03G 2215/0643* (2013.01); *G03G 2215/0621* (2013.01)
USPC ..... 399/266

(58) Field of Classification Search
CPC ..... G03G 15/0803; G03G 15/0818; G03G 2215/0621; G03G 2215/0643
USPC ..... 399/266, 271, 290, 291
See application file for complete search history.

(56) References Cited

U.S. PATENT DOCUMENTS

| | | | | |
|---|---|---|---|---|
| 4,868,600 | A | 9/1989 | Hays et al. | |
| 4,984,019 | A | 1/1991 | Folkins | |
| 5,032,872 | A * | 7/1991 | Folkins et al. | 399/266 |
| 5,270,483 | A | 12/1993 | Inoue et al. | |
| 5,321,474 | A | 6/1994 | Bares | |
| 5,338,893 | A | 8/1994 | Edmunds et al. | |
| 5,422,709 | A | 6/1995 | Minagawa et al. | |
| 5,600,416 | A * | 2/1997 | Hart | 399/291 |
| 5,640,657 | A | 6/1997 | Hart et al. | |
| 5,666,619 | A | 9/1997 | Hart et al. | |
| 6,181,896 | B1 | 1/2001 | Zirilli et al. | |
| 7,076,193 | B2 | 7/2006 | Wing et al. | |
| 7,383,973 | B2 | 6/2008 | Enyedy | |
| 2005/0265754 | A1 * | 12/2005 | Wing et al. | 399/266 |

FOREIGN PATENT DOCUMENTS

| | | | | |
|---|---|---|---|---|
| JP | 58217965 A | * | 12/1983 | G03G 15/08 |
| JP | 4299193 A | | 10/1992 | |
| JP | 6067547 A | | 3/1994 | |
| JP | 8142388 A | | 6/1996 | |

* cited by examiner

*Primary Examiner* — David Gray
*Assistant Examiner* — Thomas Giampaolo, II
(74) *Attorney, Agent, or Firm* — Fay Sharpe LLP

(57) ABSTRACT

An apparatus for developing in a development zone a latent image recorded on a surface, including a housing defining a chamber storing at least a supply of toner therein; a donor member disposed at least partially in the chamber of the housing and spaced from the surface, the donor member being adapted to rotate about a longitudinal axis to transport toner to the development zone in a region opposed from the surface; and a wire assembly module mounted in the development zone and extending in a direction transverse to the longitudinal axis, the wire assembly module including a wire and a drive/cleaning system for translating and cleaning portions of the wire in the development zone, and a power supply for electrically biasing the wire to form a toner powder cloud in the development zone for developing the latent image.

23 Claims, 7 Drawing Sheets

WIRE-WRAPPED GROOVED ROLLERS FOR CLEANING ACTION USING BRUSH-LIKE SYSTEM

BACKGROUND

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two component developer material has magnetic carrier granules with toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to a development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development system employs a magnetic brush developer roller for transporting carrier having toner adhering triboelectrically thereto. The donor roll and magnetic brush roll are electrically biased relative to one another. Toner is attracted to the donor roll from the magnetic brush roll. The donor roll transports the charged toner to a development zone. The electrically biased electrode wires detach the toner from the donor roll forming a toner powder cloud in the development zone, and the latent image attracts the toner particles thereto. In this way, the latent image recorded on the photoconductive member is developed with the toner particles. It has been found that streaks are formed in the developed latent image when debris is trapped in, or when toner and/or toner constituents builds up on the electrode wires. Heretofore, the electrode wires have been positioned substantially perpendicular to the process direction, i.e. substantially parallel to the longitudinal axis of the donor roll. Various types of development systems have hereinbefore been used incorporating electrode wires as illustrated by the following disclosures, which may be relevant to certain aspects of the present disclosure.

U.S. Pat. No. 4,868,600 describes an apparatus wherein a magnetic roll transports two component developers to a transfer region where toner from the magnetic roll is transferred to a donor roll. The donor roll transports the toner to a region opposed from a surface on which a latent image is recorded. A pair of electrode wires are positioned in the space between the surface and the donor roll and are electrically biased to detach toner from the donor roll to form a toner cloud. Detach toner from the cloud develops the latent image.

U.S. Pat. No. 4,984,019 discloses a developer unit having a donor roll with electrode wires disposed adjacent thereto in a development zone. A magnetic roll transports developer material to the donor roll. Toner particles are attracted from the magnetic roll to the donor roll. When the developer unit is inactivated, the electrode wires are vibrated to remove contaminants therefrom.

U.S. Pat. No. 5,422,709 teaches an apparatus in which a donor roll advances toner to an electrostatic latent image recorded on a photoconductive member. A plurality of electrode wires are positioned in the space between the donor roll and the photoconductive member. The electrode wires extend in a transverse direction relative to the longitudinal axis of the donor roll. The electrode wires are electrically biased to detach the toner from the donor roll so as to form a toner cloud in the space between the electrode wires and photoconductive members. Detached toner from the toner cloud develops the latent image. Electrode wires contact a portion of the surface of the donor roll. As the donor roll rotates, friction between the electrode wires and donor roll causes trapped debris to move away from the toner powder cloud region so as to minimize contamination produced streaks on the developed image.

U.S. Pat. No. 7,383,973, issued Jun. 10, 2008, by Edward A. Enyedy and entitled WIRE MODULE FOR DEVELOPER UNIT discloses a wire feeding mechanism for advancing a continuous length of wire along a pathway includes a housing having two roller supports each rotatable about a corresponding axis transverse to a wire pathway. The roller supports are on opposite sides of the pathway and are driveably engaged with each other. A drive roller is on each of the roller supports for rotation therewith. The drive roller includes an outer surface extending circumferentially about the corresponding axis. The outer surface defines a groove having an included angle of less than ninety degrees (90°). The drive roller on each of the roller supports compressively contacts a continuous length of wire between the roller supports such that the wire is advanced along the pathway in response to rotation of the drive rollers.

U.S. Pat. No. 7,076,193, issued Jul. 11, 2006, by Wing et al., and entitled "DRIVE ROLLERS FOR WIRE FEEDING MECHANISM" discloses an apparatus for developing in a development zone a latent image recorded on a surface, including a housing defining a chamber storing at least a supply of toner therein; a donor member disposed of at least partially in the chamber of the housing and spaced from the surface, the donor member being adapted to rotate about a longitudinal axis to transport toner to the development zone in a region opposed from the surface; and a wire assembly module mounted the development zone and extending in a direction transverse to the longitudinal axis, the wire assembly module including a wire and a drive system for translating portions of the wire in the development zone, and power supply for electrically biasing the wire to detach toner from the donor member so as to form a toner powder cloud in the development zone with detached toner from the toner cloud developing the latent image.

A problem with developer systems using wires is that toner and/or toner constituents buildup on the wires over time and result in development defects. Wire contamination is a first class of defect in which toner and/or toner constituents build up on the wire side that is in contact with the donor roll. Wire history is a second class of defect in which toner and/or toner constituents build up on the wire side away from the donor roll. Wire history involves highly charged (though sometimes low charged) and generally small toner or other particles being attracted to the wire and sticking to the wire as a result of either adhesive or electrostatic attractive forces. The result is that contaminants build up on the electrodes, as a response to the image area coverage history, causing visible streaks on prints. Constant cleaning of the wires is required in order to alleviate the above-defects, which cleaning is time-consuming and inefficient in that it requires machine downtime.

Another problem is in machines which require large development zones that the width of the donor roll is such that a very large number of those wires are required to cover the whole printable area. The wrapping of this many wires poses very serious manufacturability challenges. In addition, the wires must all be supported at exactly the same tension which must be maintained. This poses both a design and manufacturability challenge, when either a single wire or a plurality of wires is used.

The present disclosure and exemplary embodiments herein obviates the problems noted above by providing an apparatus for developing in a development zone a latent image recorded on a surface, including a housing defining a chamber storing at least a supply of toner therein; a donor member disposed of at least partially in the chamber of said housing and spaced from the surface, said donor member being adapted to rotate about a longitudinal axis to transport toner to the development zone in a region opposed from the surface; and a wire assembly module mounted in the development zone and extending in a direction transverse to the longitudinal axis, said wire assembly module including a wire and a drive/cleaning system for translating portions of the wire in the development zone and cleaning the wire, and a power supply for electrically biasing said wire to detach toner from said donor member so as to form a toner powder cloud in the development zone with detached toner from the toner cloud developing the latent image.

INCORPORATION BY REFERENCE

U.S. Pat. No. 4,868,600, by Hays et al., issued Sep. 19, 1989 and entitled "SCAVENGELESS DEVELOPMENT APPARATUS FOR USE IN HIGHLIGHT COLOR IMAGING";

U.S. Pat. No. 4,984,019, by Folkins, issued Jan. 8, 1991 and entitled "ELECTRODE WIRE CLEANING";

U.S. Pat. No. 5,270,483, by Inoue et al., issued Dec. 14, 1993 and entitled "DEVELOPING APPARATUS";

U.S. Pat. No. 5,321,474, by Bares, issued Jun. 14, 1994 and entitled "ACTIVE DAMPING OF ELECTRODE WIRE VIBRATION IN SCAVENGELESS DEVELOPMENT IN A XEROGRAPHIC APPARATUS";

U.S. Pat. No. 5,338,893, by Edmunds et al., issued Aug. 16, 1994 and entitled "DONOR ROLL WITH ELECTRODE SPACER FOR SCAVENGELESS DEVELOPMENT IN A XEROGRAPHIC APPARATUS"

U.S. Pat. No. 5,422,709, BY Minagawa et al., issued Jun. 6, 1995 and entitled "ELECTRODE WIRE GRID FOR DEVELOPER UNIT";

U.S. Pat. No. 5,600,416, by Hart, issued Feb. 4, 1997 and entitled "ELECTRODE WIRE TENSIONING FOR SCAVENGELESS DEVELOPMENT";

U.S. Pat. No. 5,640,657, by Hart et al., issued Jun. 17, 1997 and entitled "ELECTRODE WIRE TWISTED LOOP MOUNTING FOR SCAVENGELESS DEVELOPMENT";

U.S. Pat. No. 5,666,619, by Hart et al., issued Sep. 9, 1997 and entitled "ELECTRODE WIRE SUPPORT FOR SCAVENGELESS DEVELOPMENT";

U.S. Pat. No. 6,181,896, by Zirilli et al., issued Jan. 30, 2001 and entitled "DEVELOPMENT HOUSING HAVING IMPROVED TONER EMISSION CONTROL";

U.S. Pat. No. 7,076,193, by Wing et al., issued Jul. 11, 2006, and entitled "WIRE MODULE FOR DEVELOPER UNIT";

U.S. Pat. No. 7,383,973, by Enyedy, issued Jun. 10, 2008, and entitled "DRIVE ROLLERS FOR WIRE FEEDING MECHANISM";

JP Patent Publication No. 04-299193, Assigned to Xerox Corp., published Oct. 22, 1992 and entitled "STITCHER WIRE DISPLAY UNIT";

JP Patent Publication No. 06-067547, assigned to Fuji Xerox Co. Ltd., published Mar. 11, 1994 and entitled "DEVELOPING DEVICE"; and JP Patent Publication No. 08-142388, assigned to Brother Ind. Ltd., published Jun. 4, 1996 and entitled "IMAGE FORMING APPARATUS"; are all incorporated herein by reference in their entirety.

BRIEF DESCRIPTION

In one embodiment of this disclosure, described is an apparatus for developing in a development zone a latent image recorded on a surface, including a housing defining a chamber storing at least a supply of toner therein; a donor member disposed at least partially in the chamber of said housing and spaced from the surface, said donor member being configured to rotate about a longitudinal axis to transport toner to the development zone in a region opposed from the surface; and a wire assembly module mounted in the development zone and extending in a direction transverse to the longitudinal axis, said wire assembly module including a wire and a drive system configured to translate portions of the wire in the development zone, and the wire module configured to electrically bias said wire to detach toner from said donor member so as to form a toner powder cloud in the development zone with detached toner from the toner cloud developing the latent image, said wire assembly module further includes a stringing system configured to arrange said wire into a plurality of wires with adjacent wires being spaced from and substantially parallel to one another, the drive system including a roller configured to position the plurality of wires within a cleaning zone, the cleaning zone including a cleaning device fixed to the wire assembly module and the cleaning device configured to remove toner from the plurality of wires.

In another embodiment of this disclosure, described is an electrode wire assembly module operatively associated with a development zone comprising a plurality of wires; a stringing system configured to arrange said wires into a plurality of elongated wires with adjacent wires being spaced from and substantially parallel to one another; and a drive system configured to translate portions of the wires in the associated development zone, and the drive system including a roller configured to position the plurality of wires within a cleaning zone, the cleaning zone including a cleaning device fixed to the wire assembly module and the cleaning device configured to remove toner from the plurality of wires, wherein the wire assembly module is configured to electrically bias said wires to detach toner from an associated donor member so as to form a toner powder cloud in the associated development zone.

In still another embodiment of this disclosure, described is a printing system comprising a latent image recorded on a surface; a housing defining a chamber storing a supply of toner therein; a donor member disposed at least partially in the chamber of said housing and spaced from the surface, said donor member being configured to rotate about a longitudinal axis to transport toner to a development zone, the development zone including a region opposed from the latent image recorded on the surface; and a wire assembly mounted in the development zone and extending in a direction transverse to the longitudinal axis, said wire assembly including a wire and a drive system configured to translate portions of the wire in the development zone, the wire assembly configured to electrically bias the wire to detach toner from said donor member so as to form a toner cloud developing the latent image, the drive system including a roller configured to position the wire within a cleaning zone, the cleaning zone including a cleaning device configured to remove toner from the wire.

DETAILED DESCRIPTION

As briefly discussed above, wire pollution is a major contributor to streaks on prints. Actions by customers and service personnel to obviate or mitigate streaks increases costs, i.e. wire module and developer replacement, ATP and PWR toner, and decrease productivity, i.e. ATP and service time. One problem is that particles of toners attach to the wire module by static current and/or friction melting.

According to one aspect of this disclosure, provided is the use of two isolated groove rollers and cleaning brushes to remove attached toners, i.e. wire pollution, from the electrode wires. These rollers are rotated at a constant rpm to maintain the electrode wire displacement from one roller to the other, while the wire electrodes are cleaned by brushes. A voltage can be applied to the wire through a roller and isolated from the other roller. The rollers can dynamically rotate using a motor, pulleys or the gear assemblies.

Figure 7:
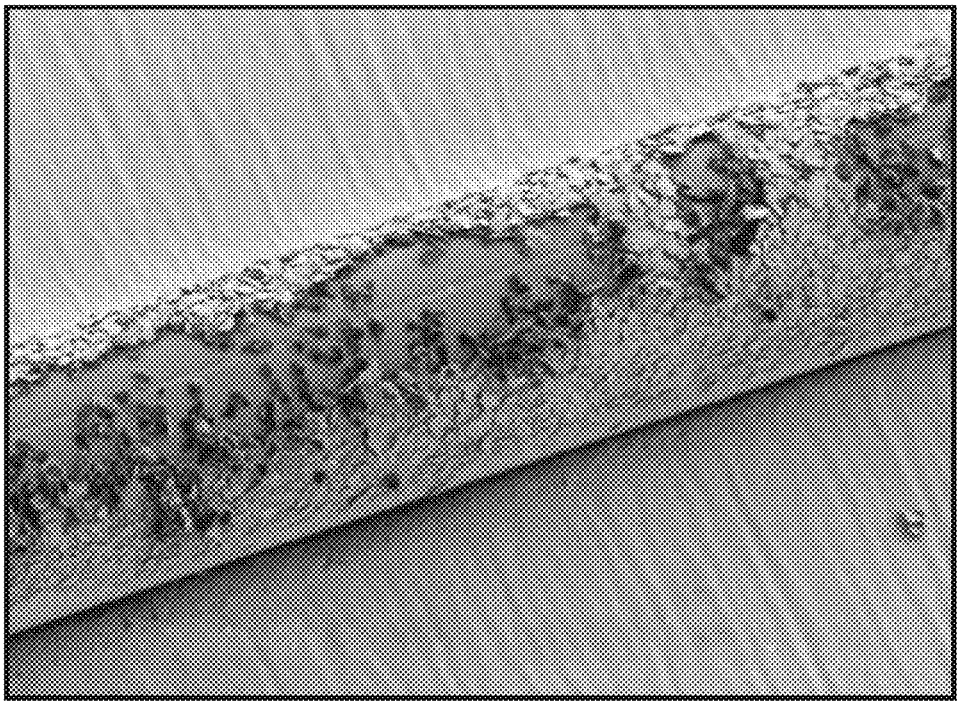
FIG. 7 is a view of a contaminated electrode wire associated with a developer module used in a xerographic process.

To avoid image quality defects after several thousand impressions, present developer housings associated with printing systems require extensive cleaning cycles and even replacement of the wire module. As shown in FIG. 7, the wire becomes polluted affecting the toner developer on a photoreceptor belt. The wire module has high voltage cables that attract the toner from the donor roll creating a cloud that the photoreceptor belt then attracts. Due to the charge remaining in the electrode wire, material sticks to the electrode wire.

Ideally, it is desirable to clean the electrode wire continuously to prevent image quality defects. However, cleaning cycles currently in use do not completely clean the wire and in some cases contribute to quality defects. For example, one method of cleaning the electrode wire is to rub the donor roll on the electrode wire, which increases the temperature of the toner due to friction and melts toner on the wire.

Figure 1:
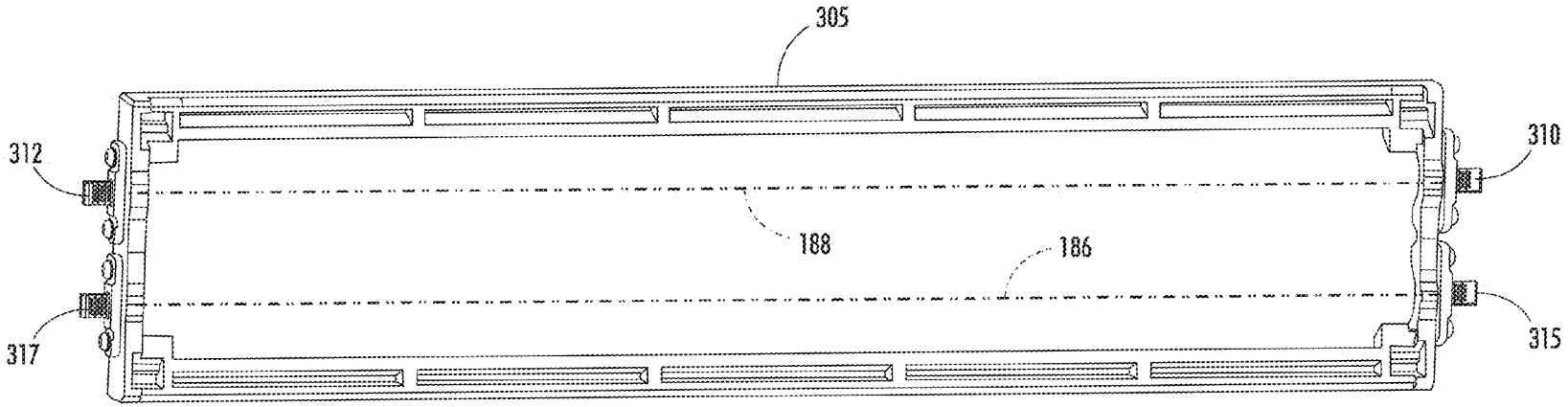
FIG. 1 illustrates a wire module including two electrode wires according to an exemplary embodiment of this disclosure.

FIG. 1 illustrates a wire module including two electrode wires 186 and 188, according to an exemplary embodiment of this disclosure. As shown, the wire module also includes electrodes 310 and 312, which provide electrical connections to electrode wire 188 and electrodes 315 and 317 which provide electrical connections to electrode wire 186.

Figure 2:
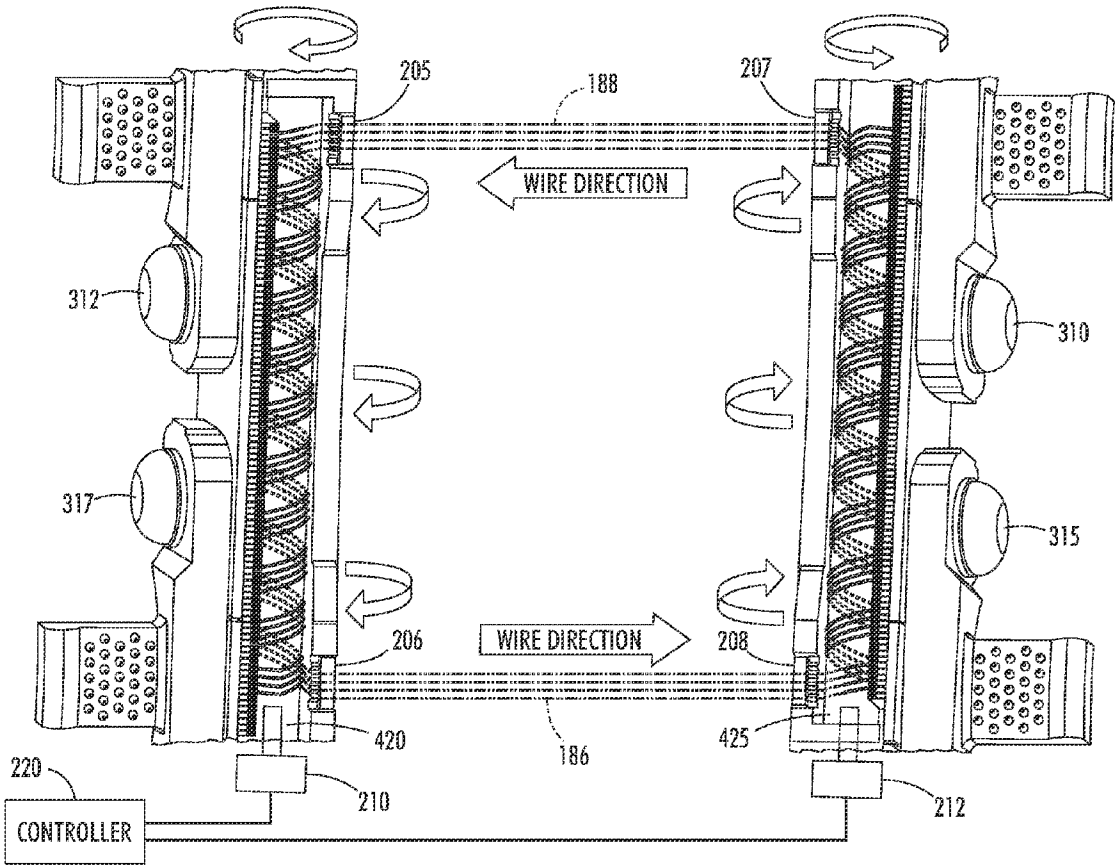
FIG. 2 is a detailed view of a wire module including an electrode brush according to an exemplary embodiment of this disclosure.

As shown in FIG. 2, this disclosure provides the use of grooved rollers 420 and 425 to maneuver the wire from inboard (IB) 186 to the outboard (OB) 188 using mechanical parts, for example a motor 210, gears, pulley, etc. The driver can be on both rollers or only one roller and functions based on a pulling and pushing effect.

Figure 3:
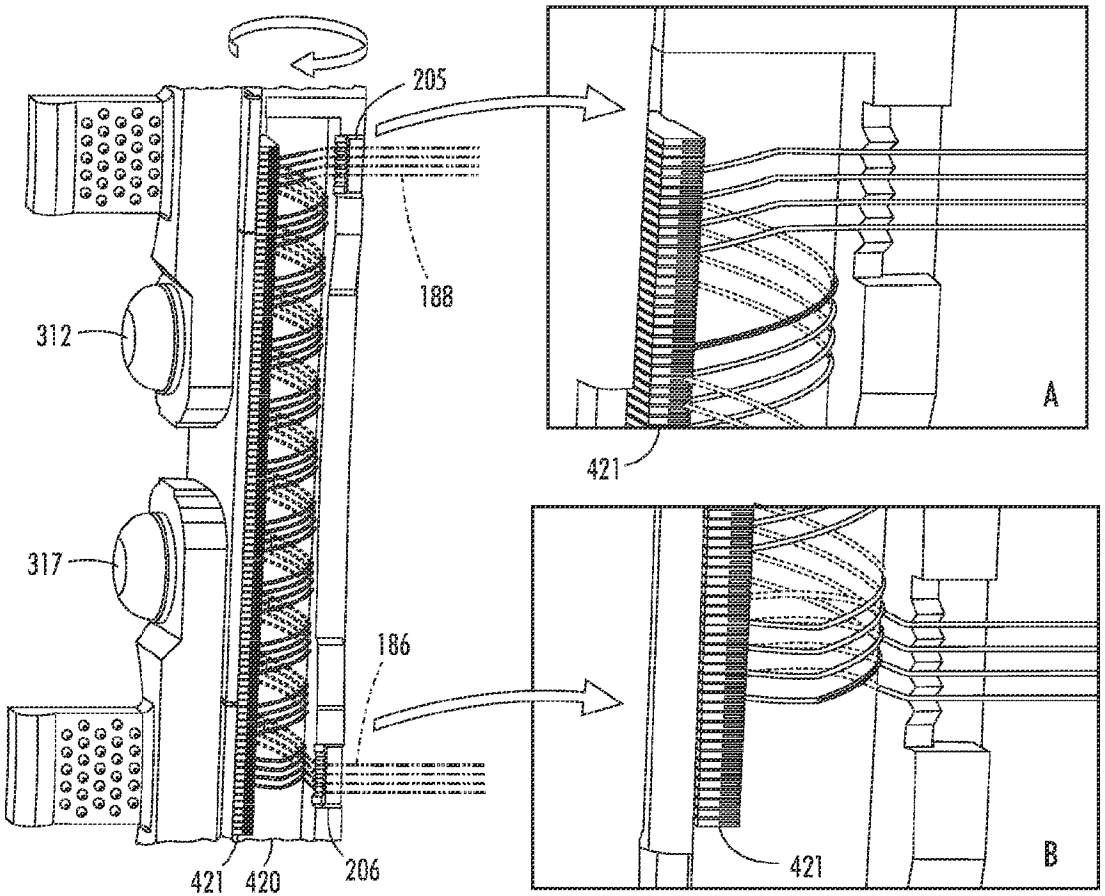
FIG. 3 is another detailed view of the wire module illustrated in FIG. 2, the view including enlarged views of the electrode wire grooves and channels, as well as the brush and electrode carrier.
Figure 4:
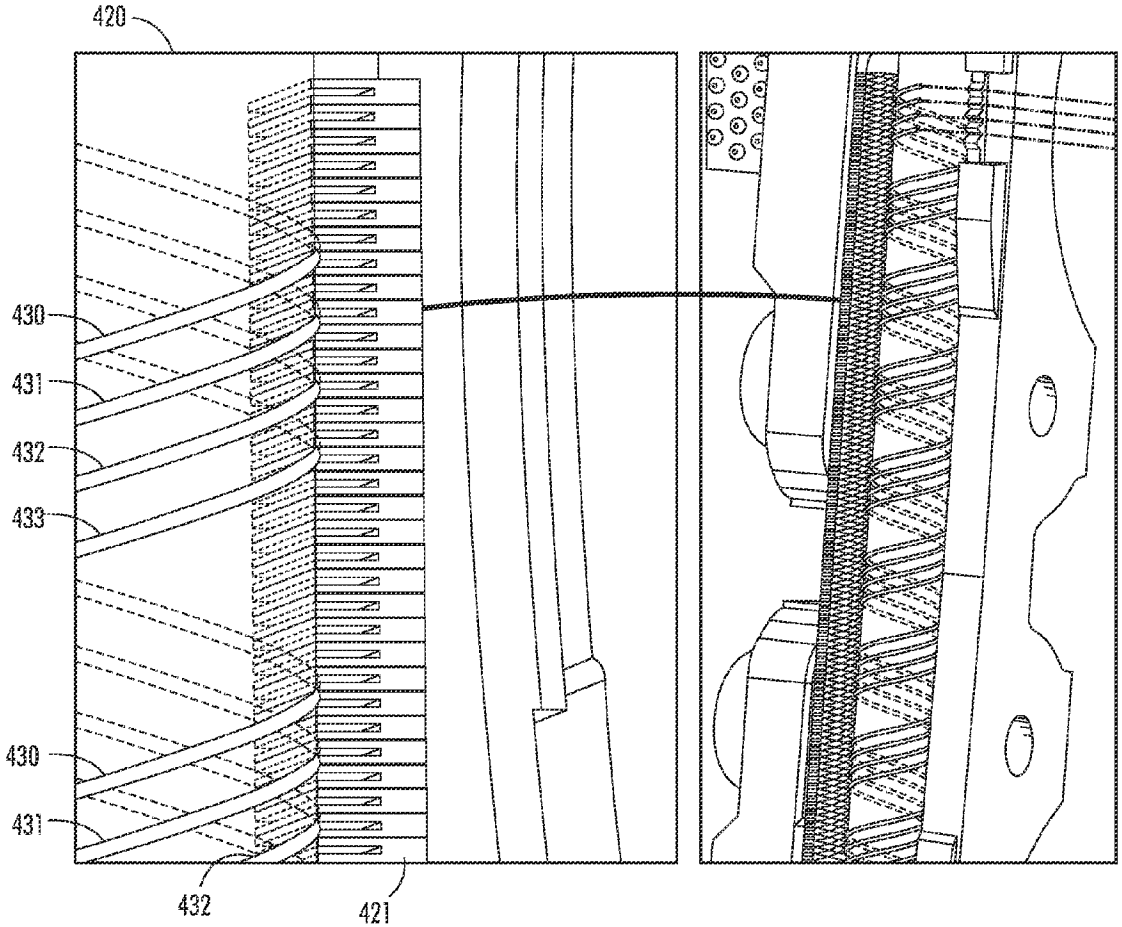
FIG. 4 is another detailed view of the wire module illustrated in FIGS. 2 and 3, including enlarged views of the electrode carrier and brush mid sections.

At the outboard location, as shown in FIG. 3, the wire enters 188 the roller grooves using wire module channels 205. Then, to increase the pulling tension the wire is wrapped around the roller 420 and re-tensioned using the wire module channel 206. At the inboard location, this procedure inverted. The input channel is at the bottom 206 and the re-tensioning is at the top 205 to secure the proper tension amount.

As the wire is advanced through the rollers groove (see FIGS. 4, 430, 431, 432 and 433), the wire is cleaned by a cleaning device 421, such as a brushing-type system polishing the wire per every turn of the roller, thereby ensuring that the toner particles attached to the wire(s) are removed.

Inasmuch as the art of electrophotographic printing is well known, the various processing stations employed in the FIG. 5 printing machine will be shown hereinafter schematically and their operation described briefly with reference thereto.

Figure 5:
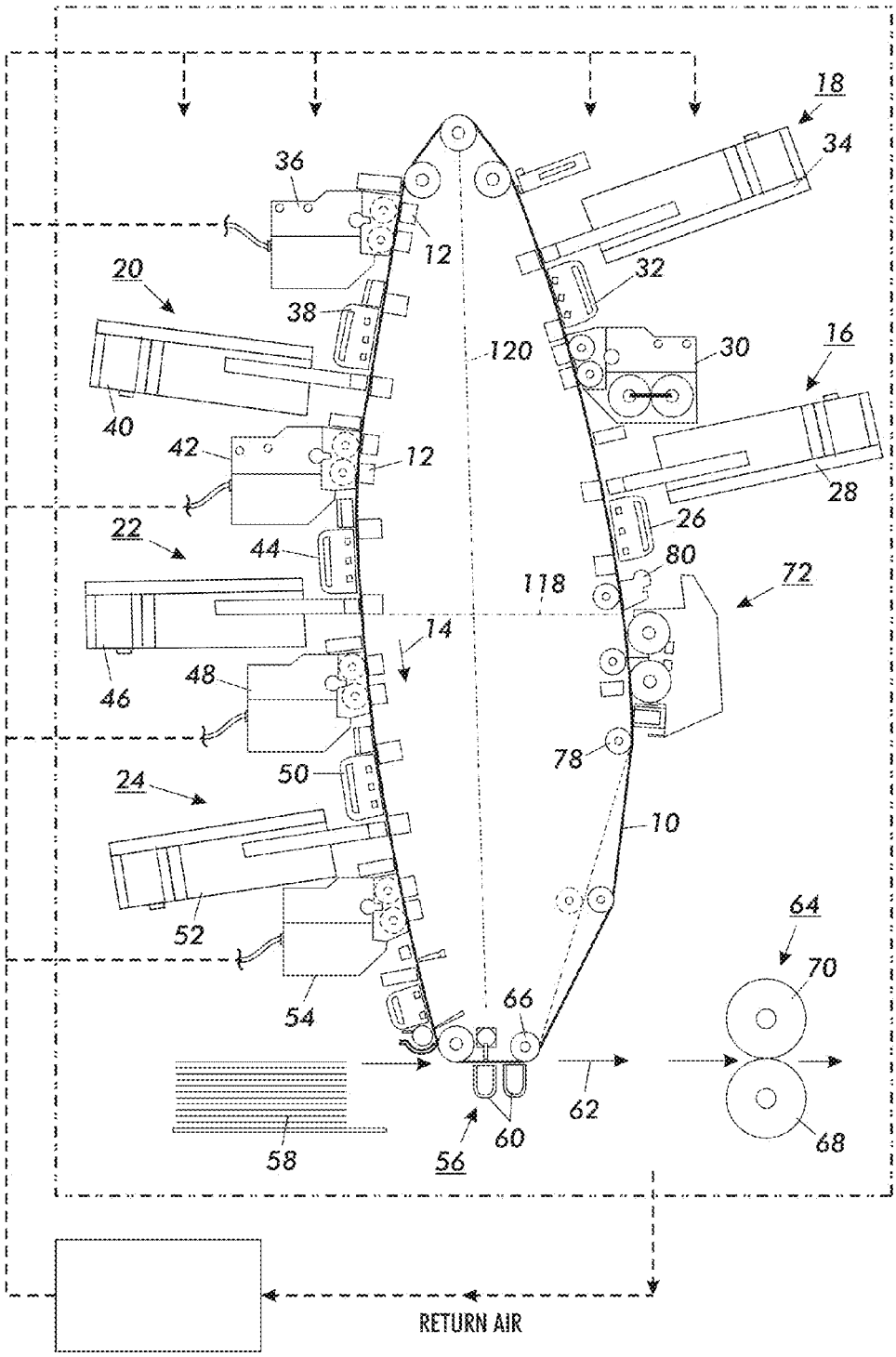
FIG. 5 is a schematic elevational view of an illustrative electrophotographic printing machine.

Referring now to the drawings, there is shown a single pass multi-color printing machine in FIG. 5. This printing machine employs the following components: a photoconductive belt 10, supported by a plurality of rollers or bars 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 118. The major and minor axes 120, 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed highlight color, yellow, magenta, and cyan toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper is stripped from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Environmental conditioning unit maintains the printing machine components enclosed in enclosure at a predefined temperature and humidity. The Environmental Unit (EU) is an air conditioning unit with dual air flow discharge to provide cooling, heating and dehumidification to the xerographic enclosure/developer housings of the print engine. The EU provides the Print Engine precise control of temperature and humidity to assure stability of the PE advanced technologies so as to produce a new industry benchmark in image quality and productivity.

Figure 6:
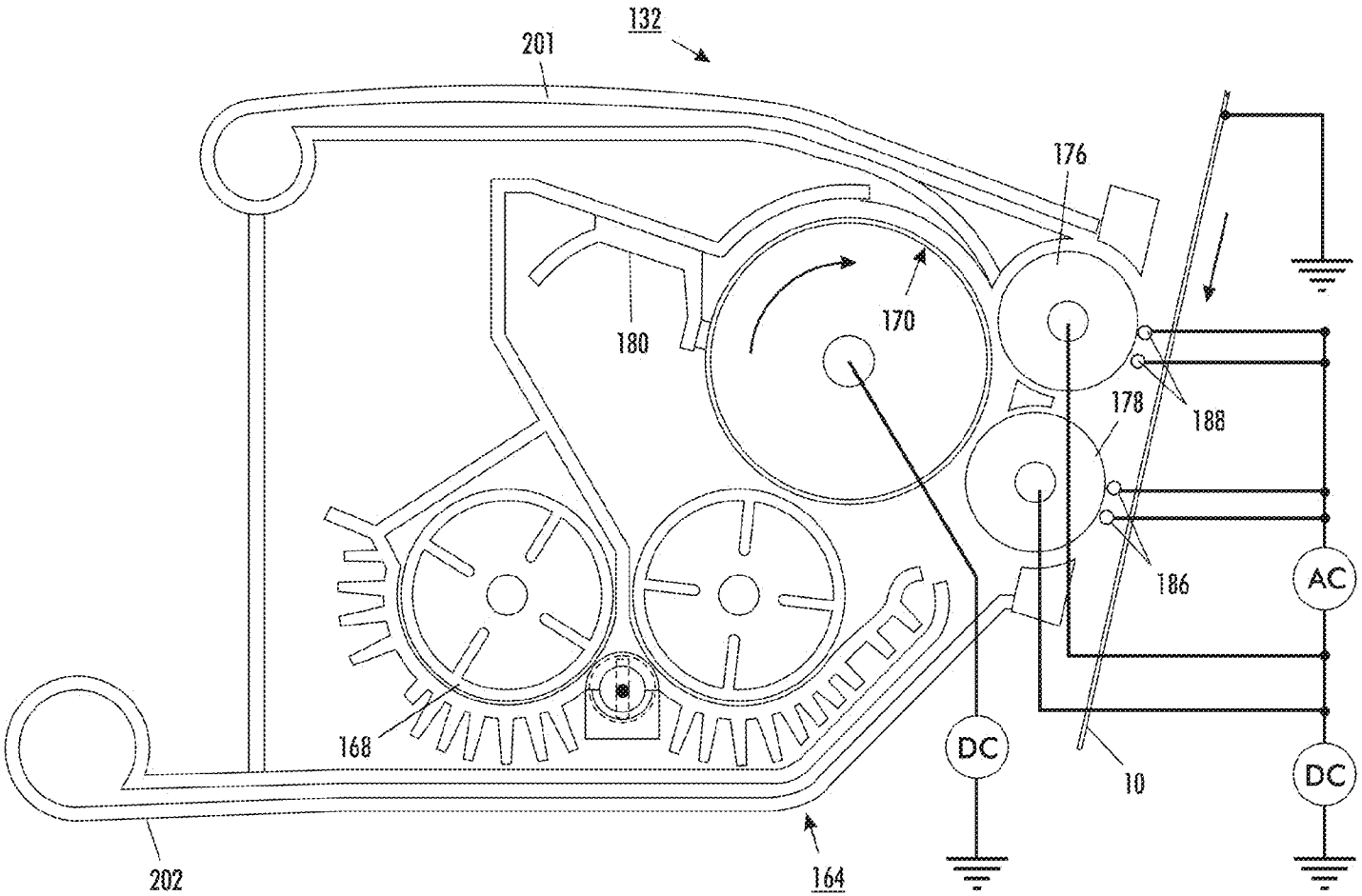
FIG. 6 is a schematic elevational view showing the development apparatus used in the FIG. 5 printing machine.

Referring now to FIG. 6, there is shown the details of a development apparatus 132 according to an exemplary embodiment of this disclosure. The apparatus comprises a reservoir or developing housing 164 containing developer material. The developer material is of the two component type, that is, it comprises carrier granules and toner particles. The reservoir 164 includes augers 168, which are rotatably-mounted in the reservoir chamber. The augers 168 serve to transport and to agitate the developer material within the reservoir 164 and encourage the toner particles to adhere triboelectrically to the carrier granules. A magnetic brush roll 170 transports developer material from the reservoir 164 to loading nips of donor rolls 176, 178. Magnetic brush rolls are well known, so the construction of magnetic brush roll 170 need not be described in great detail. Briefly the magnetic brush roll 170 comprises a rotatable tubular housing within which is located a stationary magnetic cylinder having a plurality of magnetic poles impressed around its surface. The carrier granules of the developer material are permeable, as the tubular housing of the magnetic brush roll 170 rotates, the granules (with toner particles adhering triboelectrically thereto) are attracted to the magnetic brush roll 170 and are conveyed to the donor roll loading nips. A trim bar 180 removes excess developer material from the magnetic brush roll 170 and ensures an even depth of coverage with developer material before arrival at the loading nip of donor roll 176. At each of the donor roll loading nips, toner particles are transferred from the magnetic brush roll 170 to the respective donor rolls 176, 178.

Donor rolls 176, 178 transport the toner to a respective development zone through which the photoconductive belt 10 passes. Transfer of toner from the magnetic brush roll 170 to the donor rolls 176, 178 can be encouraged by, for example, the application of a suitable D.C. electrical bias to the magnetic brush roll 170 and/or donor rolls 176, 178. The D.C. bias (for example, approximately 100 v applied to the magnetic brush roll 170) establishes an electrostatic field between the magnetic brush roll 170 and donor rolls 176,178, which causes toner particles to be attracted to the donor rolls 176, 178 from the carrier granules on the magnetic brush roll 170.

The carrier granules and any toner particles that remain on the magnetic brush roll 170 are returned to the reservoir 164 as the magnetic brush roll 170 continues to rotate. The relative amounts of toner transferred from the magnetic brush roll 170 to the donor rolls 176, 178 can be adjusted, for example by: applying different bias voltages to the donor rolls 176, 178; adjusting the magnetic brush roll to donor roll spacing; adjusting the strength and shape of the magnetic field at the loading nips and/or adjusting the speeds of the donor rolls 176, 178.

At each of the development zones, toner is transferred from the respective donor rolls 176, 178 to the latent image on the photoconductive belt 10 to form a toner powder image on the latter. In FIG. 6, each of the development zones is shown as having the form, i.e. electrode wires, 186, 188 disposed in the space between each donor rolls 176, 178 and photoconductive belt 10. FIG. 6 shows, for each donor rolls 176, 178 a respective pair of electrode wires 186, 188 extending in a direction substantially parallel to the longitudinal axis of the donor rolls 176, 178. The electrode wires 186, 188 are made from thin (i.e. 50 to 100 mu. diameter) tungsten wires which are closely spaced from the respective donor rolls 176, 178. The distance between each pair of electrode wires 186, 188 and the respective donor rolls 176, 178 is within the range from about 10μ to about 40 mu. (typically approximately 25 mu.) or the thickness of the toner layer on the donor rolls 176, 178. The electrode wires 186, 188 are self-spaced from the donor rolls 176, 178 by the thickness of the toner on the donor rolls 176, 178. To this end the extremities of the electrode wires 186, 188 are supported by a wire module disclosed herein. The electrode wires 186, 188 extremities are supported by a wire module so that they are slightly below a tangent to the surface, including the toner layer, of the donor rolls 176, 178. An alternating electrical bias is applied to the electrode wires 186, 188 by an AC voltage source.

The applied AC establishes an alternating electrostatic field between each pair of electrode wires 186, 188 and the respective donor rolls 176, 178, which is effective in detaching toner from the surface of the donor rolls 176, 178 and forming a toner cloud about the electrode wires 186, 188, the height of the cloud being such as not to be substantially in contact with the photoconductive belt 10. The magnitude of the AC voltage is relatively low, for example in the order of 200 to 500 volts peak a frequency ranging from about 3 kHz to about 10 kHz. A DC bias supply (not shown) applied to donor rolls 176, 178 establishes electrostatic fields between the photoconductive belt 10 and donor rolls 176, 178 for attracting the detached toner particles from the clouds surrounding the electrode wires 186, 188 to the latent image recorded on the photoconductive surface of the photoconductive belt 10. At a spacing ranging from about 10 mu. to about 40 mu. between the electrode wires 186, 188 and donor rolls 176, 178, an applied voltage of 200 to 500 volts produces a relatively large electrostatic field without risk of air breakdown.

After development, toner may be stripped from the donor rolls 176, 178 by respective cleaning blades (not shown) so that magnetic brush roll 170 meters fresh toner to clean donor rolls 176, 178. As successive electrostatic latent images are developed, the toner particles within the developer material are depleted. A toner dispenser (not shown) stores a supply of toner particles. The toner dispenser is in communication with reservoir 164 and, as the concentration of toner particles in the developer material is decreased, fresh toner particles are furnished to the developer material in the reservoir 164. The augers 168 in the reservoir chamber mix the fresh toner particles with the remaining developer material so that the resultant developer material therein is substantially uniform with the concentration of toner particles being optimized. In this way, a substantially constant amount of toner particles is in the reservoir 164 with the toner particles having a constant charge.

In the arrangement shown in FIG. 6, the donor rolls 176, 178 and the magnetic brush roll 170 can be rotated either "with" or "against" the direction of motion of the photoconductive belt 10. The developer housing employs a system to control toner emission which is composed of two manifolds 201 and 202. The location of the two manifolds are placed above and below the upper and lower donor rolls respectively. The manifolds are mounted in a position to improve emissions control as well as reductions in the flow needed to accomplish the task.

It is believed that the foregoing description is sufficient for purposes of the present application to illustrate the general operation of an electrophotographic printing machine incorporating the developer unit of the present invention therein.

It is, therefore, apparent that there has been provided in accordance with the present invention a development system that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An apparatus for developing in a development zone a latent image recorded on a surface, including:

a housing defining a chamber storing at least a supply of toner therein;

a donor member disposed at least partially in the chamber of said housing and spaced from the surface, said donor member being configured to rotate about a longitudinal axis to transport toner to the development zone in a region opposed from the surface; and a wire assembly module mounted in the development zone and extending in a direction transverse to the longitudinal axis, said wire assembly module including a wire and a drive system configured to translate portions of the wire in the development zone, and the wire module configured to electrically bias said wire to detach toner from said donor member so as to form a toner powder cloud in the development zone with detached toner from the toner cloud developing the latent image, said wire assembly module further includes a stringing system configured to arrange said wire into a plurality of wires with adjacent wires being spaced from and substantially parallel to one another, the drive system including a grooved roller configured to position the plurality of wires within a cleaning zone as the grooved roller rotates, the cleaning zone including a cleaning device fixed to the wire assembly module and the cleaning device configured to remove toner from the plurality of wires as the grooved roller rotates and transports the wires through the cleaning zone, wherein the grooved roller includes one or more continuous helix shaped grooves to transport the wire from a first longitudinal position of the grooved roller to a second longitudinal position of the grooved roller.

2. An apparatus according to claim 1, wherein said drive system is configured to support said plurality of wires at a preselected tension.

3. The apparatus according to claim 1, further comprising:

a second roller operatively associated with the first roller, the second roller configured to position the plurality of wires within a second cleaning zone, the second cleaning zone including a second cleaning device fixed to the wire assembly module and the cleaning device configured to remove toner from the plurality of wires.

4. The apparatus according to claim 1, wherein the cleaning device is one of a brush and a scraper.

5. The apparatus according to claim 1, wherein the roller includes grooves to position the wires within the cleaning zone.

6. The apparatus according to claim 1, further comprising:

a motor operatively connected to the roller, the motor configured to rotate the roller.

7. The apparatus according to claim 6, further comprising:

a controller operatively connected to the motor, the controller configured to control a rotational speed of the roller.

8. The apparatus according to claim 7, wherein the stringing system includes one or more channel assemblies configured to arrange said wire into a plurality of wires with adjacent wires being spaced from and substantially parallel to one another.

9. The apparatus according to claim 8, wherein the wire assembly module includes one or more electrical connection points operatively connected to the plurality of elongated wires.

10. The apparatus according to claim 1, the stringing system including one or more tensioning devices configured to adjust the tension of translated portions of the wire in the development zone.

11. An electrode wire assembly module operatively associated with a development zone comprising:

a plurality of wires;

a stringing system configured to arrange said wires into a plurality of elongated wires with adjacent wires being spaced from and substantially parallel to one another; and a drive system configured to translate portions of the wires in the associated development zone, and the drive system including a grooved roller configured to position the plurality of wires within a cleaning zone as the grooved roller rotates, the cleaning zone including a cleaning device fixed to the wire assembly module and the cleaning device configured to remove toner from the plurality of wires as the grooved roller rotates and transports the wires through the cleaning zone, wherein the grooved roller includes one or more continuous helix shaped grooves to transport the wire from a first longitudinal position of the grooved roller to a second longitudinal position of the grooved roller, wherein the wire assembly module is configured to electrically bias said wires to detach toner from an associated donor member so as to form a toner powder cloud in the associated development zone.

12. The wire assembly module according to claim 11, wherein said drive system is configured to support said plurality of wires at a preselected tension.

13. The wire assembly module according to claim 11, the drive system further comprising:

a second roller operatively associated with the first roller, the second roller configured to position the plurality of wires within a second cleaning zone, the second cleaning zone including a second cleaning device fixed to the wire assembly module and the cleaning device configured to remove toner from the plurality of wires.

14. The wire assembly module according to claim 11, wherein the cleaning device is one of a brush and a scraper.

15. The wire assembly according to claim 11, wherein the roller includes grooves to position the wires within the cleaning zone.

16. The wire assembly module according to claim 11, further comprising:

a motor operatively connected to the roller, the motor configured to rotate the roller.

17. The wire assembly module according to claim 16, further comprising:

a controller operatively connected to the motor, the controller configured to control a rotational speed of the roller.

18. The wire assembly module according to claim 17, wherein the stringing system includes one or more channel assemblies configured to arrange said wire into a plurality of wires with adjacent wires being spaced from and substantially parallel to one another.

19. The wire assembly module according to claim 18, wherein the wire assembly module includes one or more electrical connection points operatively connected to the plurality of elongated wires.

20. The wire assembly module according to claim 11, the stringing system including one or more tensioning devices configured to adjust the tension of translated portions of the wire in the development zone.

21. A printing system comprising:

a latent image recorded on a surface;

a housing defining a chamber storing a supply of toner therein;

a donor member disposed at least partially in the chamber of said housing and spaced from the surface, said donor member being configured to rotate about a longitudinal axis to transport toner to a development zone, the development zone including a region opposed from the latent image recorded on the surface; and a wire assembly mounted in the development zone and extending in a direction transverse to the longitudinal axis, said wire assembly including a wire and a drive system configured to translate portions of the wire in the development zone, and the wire assembly configured to electrically bias said wire to detach toner from said donor member so as to form a toner cloud developing the latent image, said wire assembly further includes a stringing system configured to arrange said wire into a plurality of wires with adjacent wires being spaced from and substantially parallel to one another, the drive system including a grooved roller configured to position the plurality of wires within a cleaning zone as the grooved roller rotates, the cleaning zone including a cleaning device configured to remove toner from the plurality of wires as the grooved roller rotates and transports the wires through the cleaning zone, wherein the grooved roller includes one or more continuous helix shaped grooves to transport the wire from a first longitudinal position of the grooved roller to a second longitudinal position of the grooved roller.

22. The printing system according to claim 21, further comprising:

a motor operatively connected to the roller, the motor configured to rotate the roller; and a controller operatively connected to the motor, the controller configured to control a rotational speed of the roller.

23. The printing system according to claim 22, further comprising:

a second roller operatively associated with the first roller; and a second motor operatively connected to the second roller, the second motor configured to rotate the second motor, wherein the controller is operatively connected to the first and second motors, and the controller is configured to control the rotational speed of the first roller and a rotational speed of the second roller.

* * * * *